US007421855B2

(12) United States Patent
Ring et al.

(10) Patent No.: US 7,421,855 B2
(45) Date of Patent: Sep. 9, 2008

(54) GAS TRAP DISTRIBUTOR FOR AN EVAPORATOR

(75) Inventors: H. Kenneth Ring, Houston, MN (US); Kenneth J. Schultz, Onalaska, WI (US); Steven J. Pitts, La Crescent, MN (US); Ronald M. Cosby, II, La Crosse, WI (US); Brian T. Sullivan, La Crosse, WI (US)

(73) Assignee: Trane International Inc., Piscataway, NJ (US)

( * ) Notice: Subject to any disclaimer, the term of this patent is extended or adjusted under 35 U.S.C. 154(b) by 118 days.

(21) Appl. No.: 11/649,541

(22) Filed: Jan. 4, 2007

(65) Prior Publication Data

US 2008/0163637 A1 Jul. 10, 2008

(51) Int. Cl.
*F25B 39/02* (2006.01)

(52) U.S. Cl. ..... 62/525; 62/512

(58) Field of Classification Search ..... 62/512, 62/524, 525, 526; 165/172, 115
See application file for complete search history.

(56) References Cited

U.S. PATENT DOCUMENTS

| | | | | |
|---|---|---|---|---|
| 2,012,183 | A | 8/1935 | Carrier | |
| 2,314,402 | A | 3/1943 | Jones | |
| 3,240,265 | A | 3/1966 | Weller | |
| 3,789,617 | A | 2/1974 | Rannow | |
| 5,836,382 | A | 11/1998 | Dingle et al. | |
| 6,293,112 | B1 * | 9/2001 | Moeykens et al. | 62/84 |
| 6,516,627 | B2 * | 2/2003 | Ring et al. | 62/471 |
| 6,655,173 | B2 | 12/2003 | Iritani et al. | |

* cited by examiner

*Primary Examiner*—Melvin Jones
(74) *Attorney, Agent, or Firm*—William O'Driscoll

(57) ABSTRACT

A shell-and-tube evaporator of a refrigerant system includes a refrigerant inlet distributor that traps a pocket of gaseous refrigerant to displace liquid refrigerant underneath the evaporator's tube bundle, thereby reducing the total charge of refrigerant in the evaporator. In some embodiments, the distributor comprises four sections interconnected by a central refrigerant feed line, which properly apportions the refrigerant to the four sections.

27 Claims, 6 Drawing Sheets

GAS TRAP DISTRIBUTOR FOR AN EVAPORATOR

BACKGROUND OF THE INVENTION

1. Field of the Invention

The present invention generally relates to a shell-and-tube evaporator of a refrigerant system. More particularly, the present invention relates to a distributor that directs the flow of a two-phase refrigerant mixture entering the evaporator.

2. Description of Related Art

The primary components of a refrigeration chiller include a compressor, a condenser, an expansion device and an evaporator. Higher pressure refrigerant gas is delivered from the compressor to the condenser where the refrigerant gas is cooled and condensed to the liquid state. The condensed refrigerant passes from the condenser to and through the expansion device. Passage of the refrigerant through the expansion device causes a pressure drop therein and the further cooling thereof. As a result, the refrigerant delivered from the expansion device to the evaporator is a relatively cool, saturated two-phase mixture.

The two-phase refrigerant mixture delivered to the evaporator is brought into contact with a tube bundle disposed therein and through which a relatively warmer heat transfer medium, such as water, flows. That medium will have been warmed by heat exchange contact with the heat load which it is the purpose of the refrigeration chiller to cool. Heat exchange contact between the relatively cool refrigerant and the relatively warm heat transfer medium flowing through the tube bundle causes the refrigerant to vaporize and the heat transfer medium to be cooled. The now cooled medium is returned to the heat load to further cool the load while the heated and now vaporized refrigerant is directed out of the evaporator and is drawn into the compressor for recompression and delivery to the condenser in a continuous process.

The rate of heat transfer from the refrigerant to the chilled fluid can be maximized by wetting the evaporator's entire tube bundle with liquid refrigerant. Consequently, various evaporators and distributors have been designed for this purpose. Examples of such systems are disclosed in U.S. Pat. Nos. 2,012,183; 2,314,402; 3,240,265; 3,789,617; 5,836,382 and 6,655,173.

The '183 patent shows a pan for collecting liquid refrigerant draining from a tube bundle of a cylindrical shell evaporator. A pump draws the liquid refrigerant from the pan and sprays it back over the top of the tube bundle. The pan is said to minimize the amount of unused refrigerant that would otherwise be found below the tube bundle. The pump and overhead sprayer, however, add cost and complexity to the overall system.

The '402 patent illustrates what appears to be some sort of liquid refrigerant distributor underneath the evaporator's tube bundle. Since the distributor is fed by refrigerant "in liquid form," as stated in the patent, it appears that such a distributor could contain a significant amount of liquid refrigerant that would be sheltered in a relatively ineffective heat transfer area below the tube bundle.

The '265 patent discloses an evaporator with a horizontal plate that helps create a vaporous refrigerant chamber underneath a partially submerged tube bundle. The plate and chamber, however, apparently are not used as a distributor of liquid refrigerant because a vertical pipe equalizes the pressure above and below the plate. Thus, there is generally little or no flow through the hole in the plate. Instead, the chamber is simply used for insulating the liquid refrigerant from the surrounding ambient air.

The '617 and '173 patents each disclose what appears to be a perforated horizontal plate that might serve as a liquid refrigerant distributor for an overhead tube bundle. Due to the orientation of the plates and their holes, it looks like the area underneath the plates can fill with liquid refrigerant, thus it appears that neither plate provides any significant reduction in liquid refrigerant.

The '382 patent shows a distributor disposed beneath the tube bundle of an evaporator. The distributor, however, displaces an inconsequential amount of liquid refrigerant, as the distributor is above the floor of the evaporator shell, so liquid refrigerant can collect in that area. Moreover, liquid refrigerant can also collect in areas along side the distributor as well as above and inside the distributor.

Consequently, a need exists for a refrigerant distributor that minimizes the amount of liquid refrigerant in an evaporator shell while evenly wetting the evaporator's entire tube bundle along the full length of the shell.

SUMMARY OF THE INVENTION

It is an object of the present invention to provide an evaporator with a distributor that minimizes the amount of liquid refrigerant necessary to completely wet a tube bundle within the evaporator.

It is also an object of the present invention to reduce the refrigerant charge in an evaporator by using the gaseous refrigerant of a two-phase refrigerant to displace the liquid portion, which would otherwise collect below the tube bundle.

It is another object of the present invention to provide an evaporator with a distributor that not only evenly distributes liquid refrigerant across a tube bundle but also displaces a significant amount of liquid refrigerant below the tube bundle, thereby minimizing the total amount of liquid refrigerant needed in the evaporator.

It is also an object of some embodiments to apportion a source of liquid refrigerant among four sections of a distributor, wherein the four sections are axially distributed along the length of the evaporator. This allows the evaporator's tube bundle to receive an even distribution of refrigerant even if the evaporator is divided along its length by axially distributed baffles or tube supports.

It is also an object of the present invention to trap a pocket of gaseous refrigerant within a distributor, thereby displacing liquid refrigerant that would otherwise fill that space.

It is a further object of the present invention to trap a pocket of gaseous refrigerant at an elevation that at times can be between upper and lower liquid/vapor refrigerant levels within an evaporator.

It is a still further object of the present invention to trap a pocket of gaseous refrigerant at a pressure that is higher than the refrigerant surrounding a tube bundle within the evaporator.

It is an additional object of some embodiments to provide a distributor with a gas trap chamber that leaks at a volume flow rate that is less than the volume flow rate of gaseous refrigerant flowing into the distributor.

It is another object of the present invention to provide a distributor with a sidewall and a ceiling that create a gas trap chamber inside the distributor, wherein the sidewall defines one or more outlets for releasing liquid refrigerant near the bottom the distributor.

It is yet another object of some embodiments to provide an evaporator with two distributors that define a refrigerant passageway therebetween.

One or more of these and/or other objects of the invention are provided by a distributor that reduces the refrigerant charge in an evaporator by using the gaseous portion of a two-phase refrigerant mixture to displace some the liquid portion of the mixture.

BRIEF DESCRIPTIONS OF THE DRAWINGS

DESCRIPTIONS OF THE PREFERRED EMBODIMENT

Figure 1:
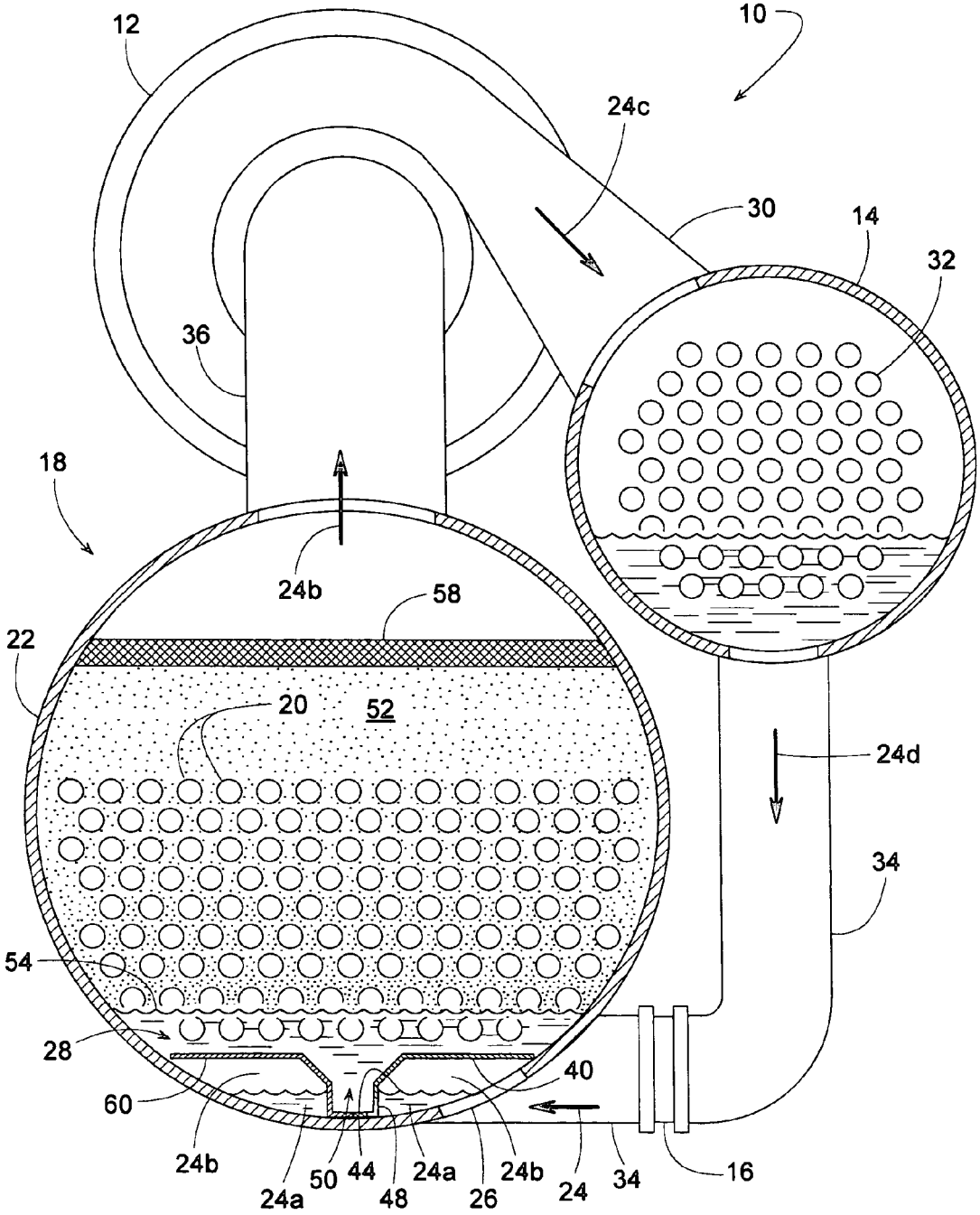
FIG. 1 is a schematic cross-sectional end view a refrigerant system that includes an evaporator with a novel distributor.
Figure 2:
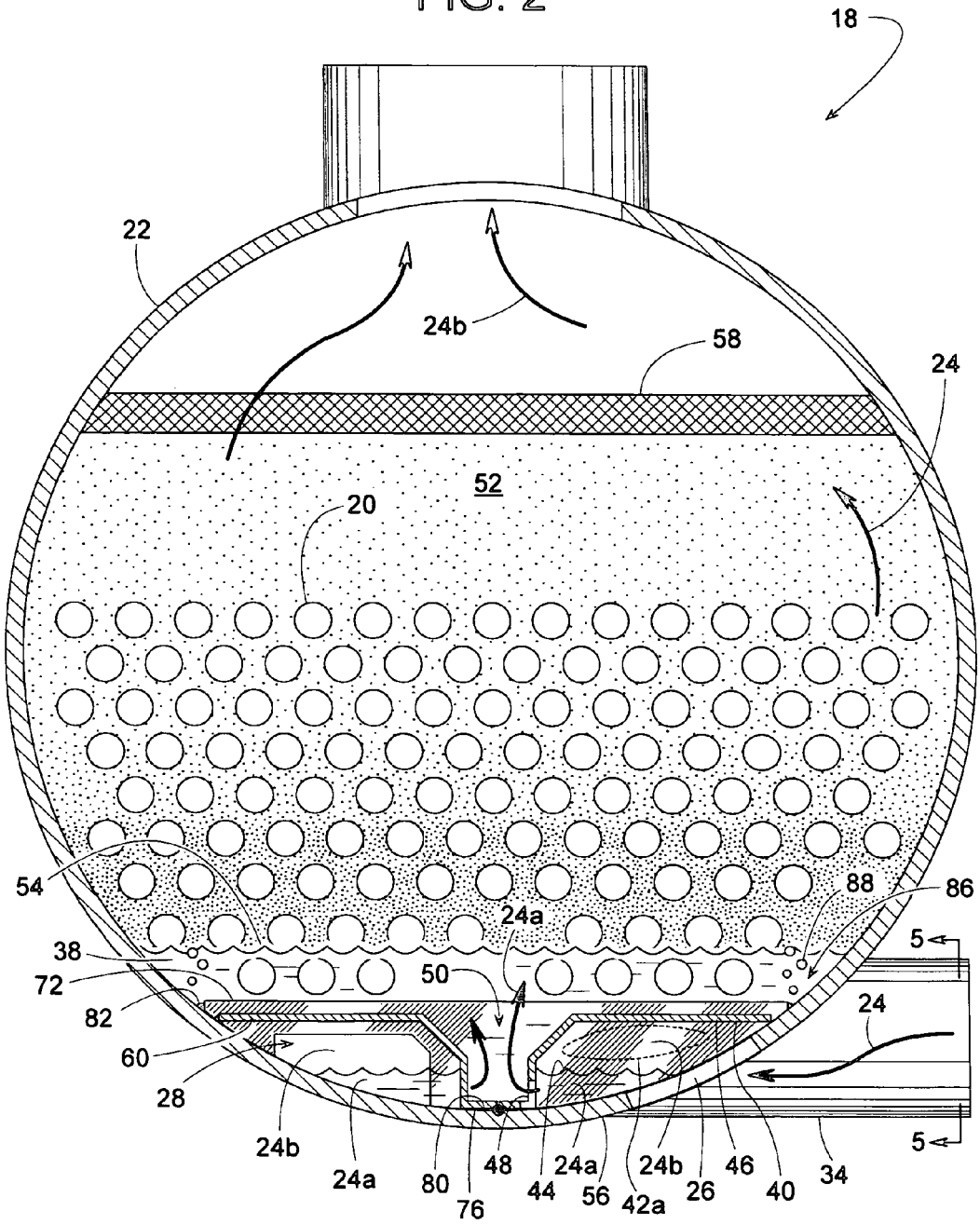
FIG. 2 is a cross-sectional view similar to FIG. 1 but primarily showing the evaporator and the distributor.

Referring to FIG. 1, the present invention will be described with reference to a basic refrigerant system 10 having four main components comprising a compressor 12, a condenser 14, an expansion device 16 and an evaporator 18 (FIG. 2). It should be noted, however, that system 10 serves as a basic model and that countless variations of system 10 are well within the scope of the invention. In some embodiments, for instance, system 10 further includes a conventional economizer whose structure and function are well known to those of ordinary skill in the art.

Compressor 12 can be any type of compressor including, but not limited to, a centrifugal, screw, scroll or reciprocating compressor. Expansion device 16 is any suitable flow restriction such as an orifice, an orifice plate (i.e., plate with a plurality of flow restricting orifices), capillary tube, reduced diameter pipe, valve, etc. Evaporator 18 is preferably a shell-and-tube heat exchanger comprising a plurality of heat exchanger tubes 20 disposed within an evaporator shell 22. Although R123 is the currently preferred refrigerant, system 10 could conceivably handle a wide variety of other refrigerants as well.

As a two-phase refrigerant 24 (mixture of liquid refrigerant 24*a* and gaseous/vaporous refrigerant 24*b*) enters an inlet 26 of evaporator 18, a novel distributor system 28 evenly distributes the liquid portion 24*a* of the refrigerant across the plurality of tubes 20. To reduce the total amount of refrigerant charge within evaporator 18, distributor 28 uses the gaseous portion 24*b* of refrigerant 24 to displace some of the liquid portion 24*a* that would otherwise collect in a relatively ineffective area underneath the plurality of heat exchanger tubes 20.

The main components of chiller system 10 are connected in series-flow relationship to create a conventional closed-loop refrigerant circuit for providing chilled water. In basic operation, compressor 12 discharges compressed gaseous refrigerant 24*c* through a discharge line 30 that leads to condenser 14. A cooling fluid passing through a tube bundle 32 in condenser 14 cools and condenses the refrigerant.

A line 34 conveys condensed refrigerant 24*d* from condenser 14 through expansion device 16. Upon passing through expansion device 16, the refrigerant cools by expansion before entering inlet 26 and distributor 28 as the two-phase mixture 24 of liquid and gaseous refrigerant. If the refrigerant is R123, the refrigerant mixture 24 flowing from expansion device 16 to distributor 28 can be comprised of over 90% gaseous refrigerant 24*b* by volume and over 90% liquid refrigerant 24*a* by weight.

Distributor 28 directs the mixture of liquid refrigerant 24*a* and gaseous refrigerant 24*b* upward past heat exchanger tubes 20. The refrigerant mixture flowing upward through evaporator 18 is generally a vaporous mist of gaseous refrigerant with entrained liquid refrigerant droplets. The liquid refrigerant droplets wet the exterior surface of tubes 20 and vaporize upon cooling a heat absorbing fluid flowing therein. The heat absorbing fluid, which can be water or some other fluid, can be pumped to remote locations for various cooling purposes. Meanwhile, the vaporized refrigerant 24*b* in evaporator 18 returns to a suction line 36 of compressor 12 to repeat the refrigerant cycle.

To minimize the refrigerant charge in evaporator 18, system 10 includes at least one distributor 40 that creates at least one gas trap chamber 42*a*, as shown in FIG. 2. In some embodiments, chamber 42*a* is defined as being the space between distributor 40 and a bottom portion 56 of shell 18. As mixture 24 of liquid and gaseous refrigerant enters evaporator 18 through inlet 26, the refrigerant mixture goes into the distributor's gas trap chamber 42*a*. Liquid refrigerant 24*a* naturally flows along the bottom of chamber 42*a*, while gaseous refrigerant 24*b* rises to the top. This creates a pocket of trapped gas/vapor 24*b* between a lower liquid/vapor refrigerant level 44 and a ceiling 46 of chamber 42*a*. Since the trapped gaseous refrigerant 24*b* displaces liquid refrigerant 24*a*, less refrigerant is needed in evaporator 18.

From chamber 42*a*, the liquid refrigerant 24*a* flows out through at least one outlet 48 near the bottom of distributor 28 and then flows upward through a refrigerant passageway 50 to enter an evaporating chamber 52 containing tubes 20. Depending on the cooling load or other operating conditions, liquid refrigerant 24*a* may or may not create a pool 38 of liquid refrigerant in evaporating chamber 52. If a pool 38 is created, it may have an upper liquid/vapor refrigerant level 54 that is sufficient to partially or completely submerge one or more rows of heat exchanger tubes 20.

Regardless of whether pool 38 exists, a mist of refrigerant rises through evaporating chamber 52 to wet the exterior surface of tubes 20. To inhibit the liquid droplets of the refrigerant mist from being drawn into suction line 36 of compressor 12, evaporator 18 preferably includes some type of demister 58 or conventional liquid/vapor separator.

Referring further to FIGS. 3-6, to more broadly distribute liquid refrigerant 24*a* across tubes 20, distributor system 28 may actually comprise first distributor 40 and a second distributor 60, wherein first distributor 40 defines first gas trap chamber-A 42*a* and a first gas trap chamber-B 42*b*, and second distributor 60 defines a second gas trap chamber-A 62*a* and a second gas trap chamber-B 62*b*, whereby distributor system 28 comprise four sections 64, 66, 68 and 70 that respectively contain gas trap chambers 42*a*, 42*b*, 62*a* and 62*b*.

A conduit 72, such as an inverted channel, can be used to place the four sections of the two distributors 40 and 60 in fluid communication with each other. It should be noted, however, that many other types of conduits or manifolds, such as pipe or tubing installed on the interior or exterior of evaporator shell 22 are also well within the scope of the invention. Conduit 72 is intentionally not shown in FIG. 1 to more clearly show other features of the invention, such as refrigerant passageway 50; however, conduit 72 is shown in FIG. 2. Some of the structural details of distributor system 28 can be better understood with reference to FIGS. 3-6.

Each distributor section 64, 66, 68 and 70 can be formed of sheet metal with an endplate 74 welded at one end. The distributor sections may be of different lengths, or they can all be the same. The distributor sections may have a lower flange 76 that helps align section 64 to section 68 and align section 66 to section 70. Notches 78 in flanges 76 provide convenient spots for welding flange 76 to a lower surface 80 of shell 22. An outer edge 82 of the distributor sections can be welded to shell 22 via intermittent weld beads 84. The space between weld beads 84 may create a leak path 86 for gaseous refrigerant 88 to escape gas trap chamber 42; however, this does not create a problem as long the volume flow rate of the leak is less than the volume flow rate of the gaseous refrigerant 24*b* entering chamber 42 from inlet 26.

Figure 6:
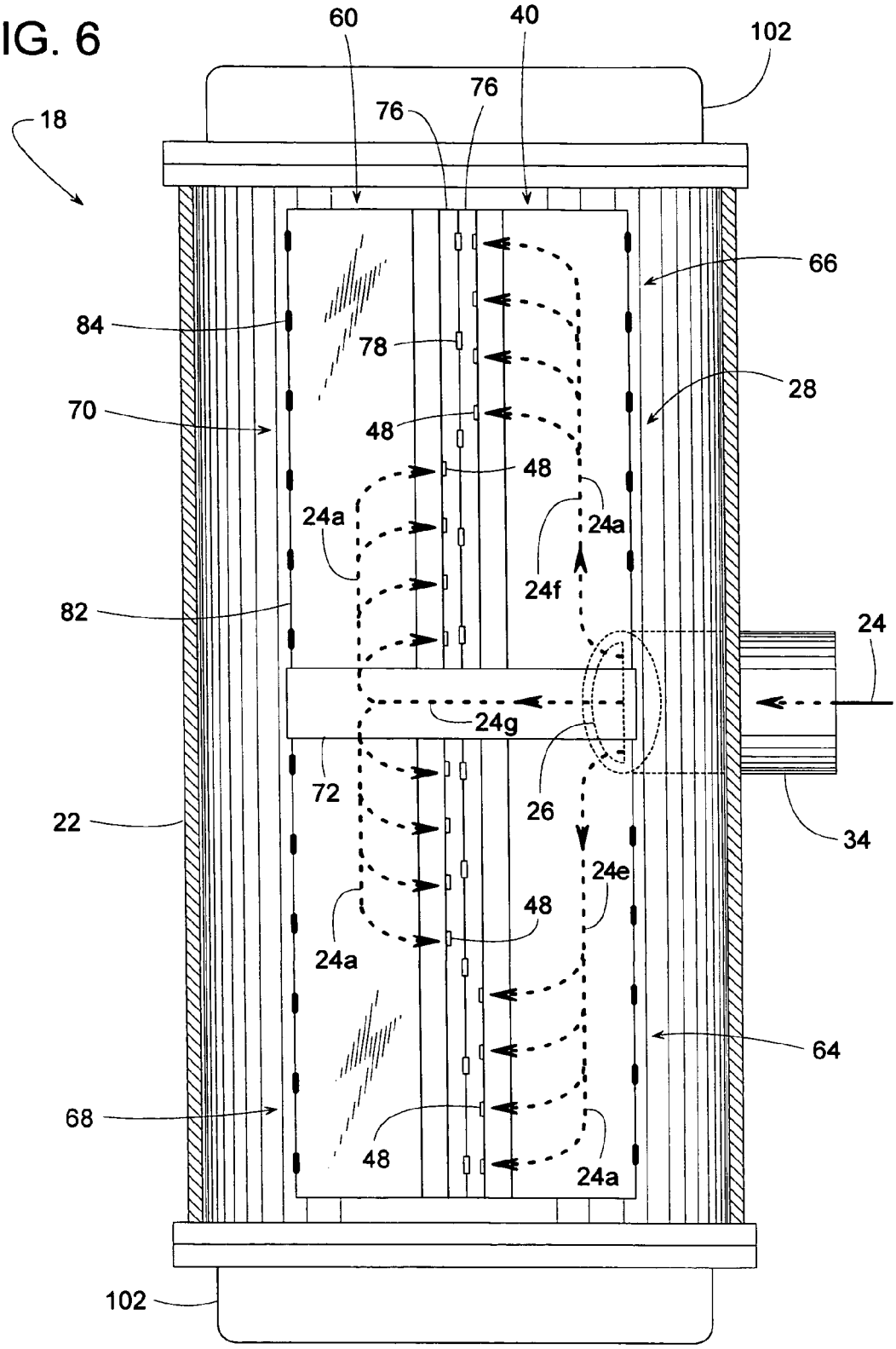
FIG. 6 is a cut-away top view of the evaporator.

To evenly distribute liquid refrigerant 24*a* along the full length of the heat exchanger tubes 20, each distributor section 64, 66, 68 and 70 can be provided with a series of outlets 48, wherein each series can be at a different position along the length of shell 22, as shown in FIG. 6. Sections 68 and 70, for instance may have their series of outlets 48 near the center of shell 22, while the series of outlets 48 in sections 64 and 66 are near the ends of shell 12, or vice versa. There are, of course, countless other possible distribution patterns of outlets 48. In some cases, for example, outlets 48 are positioned to feed certain areas between tube-supporting baffles that might be installed inside evaporator shell 22.

Figure 3:
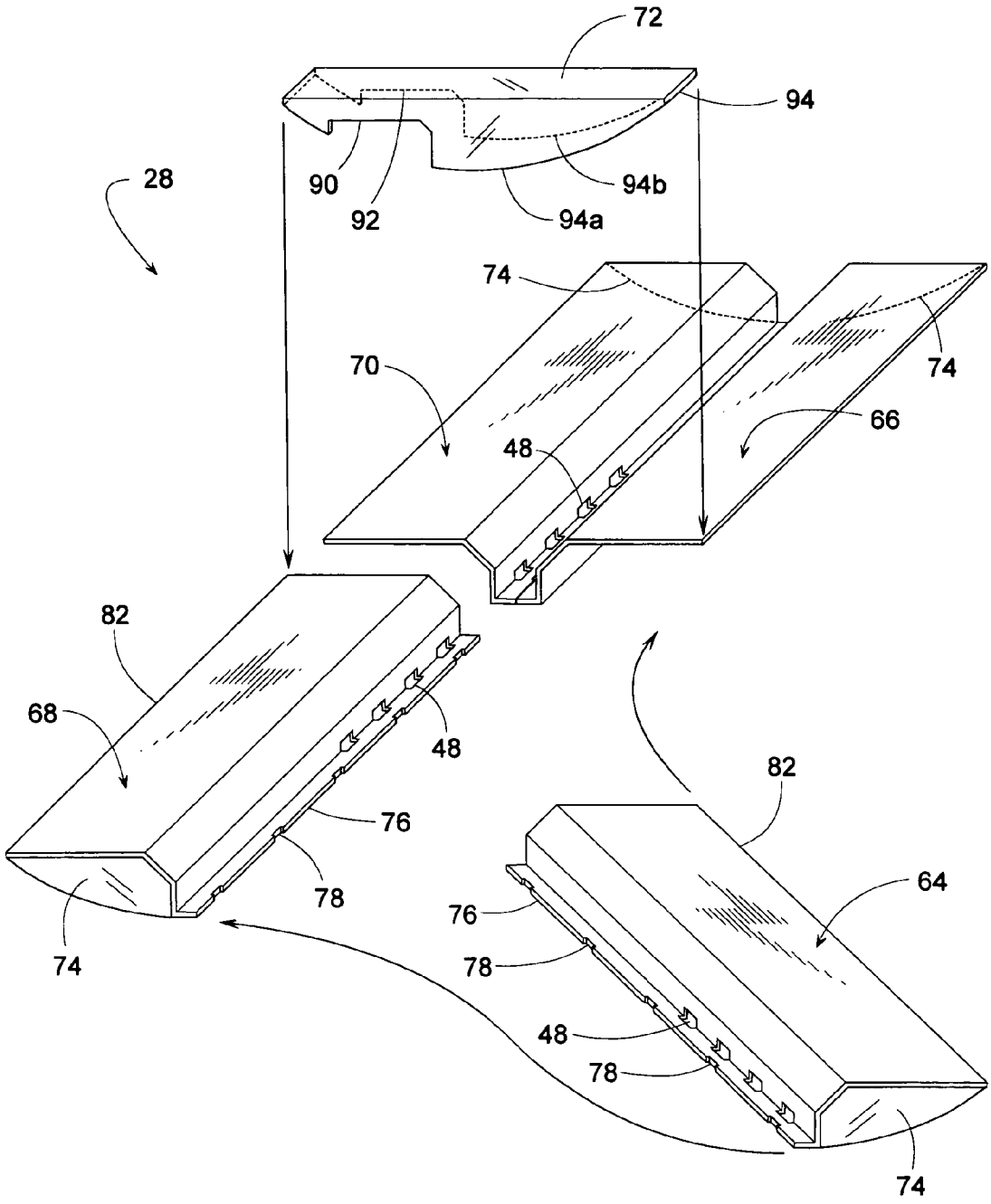
FIG. 3 is an exploded perspective view of the distributor.
Figure 4:
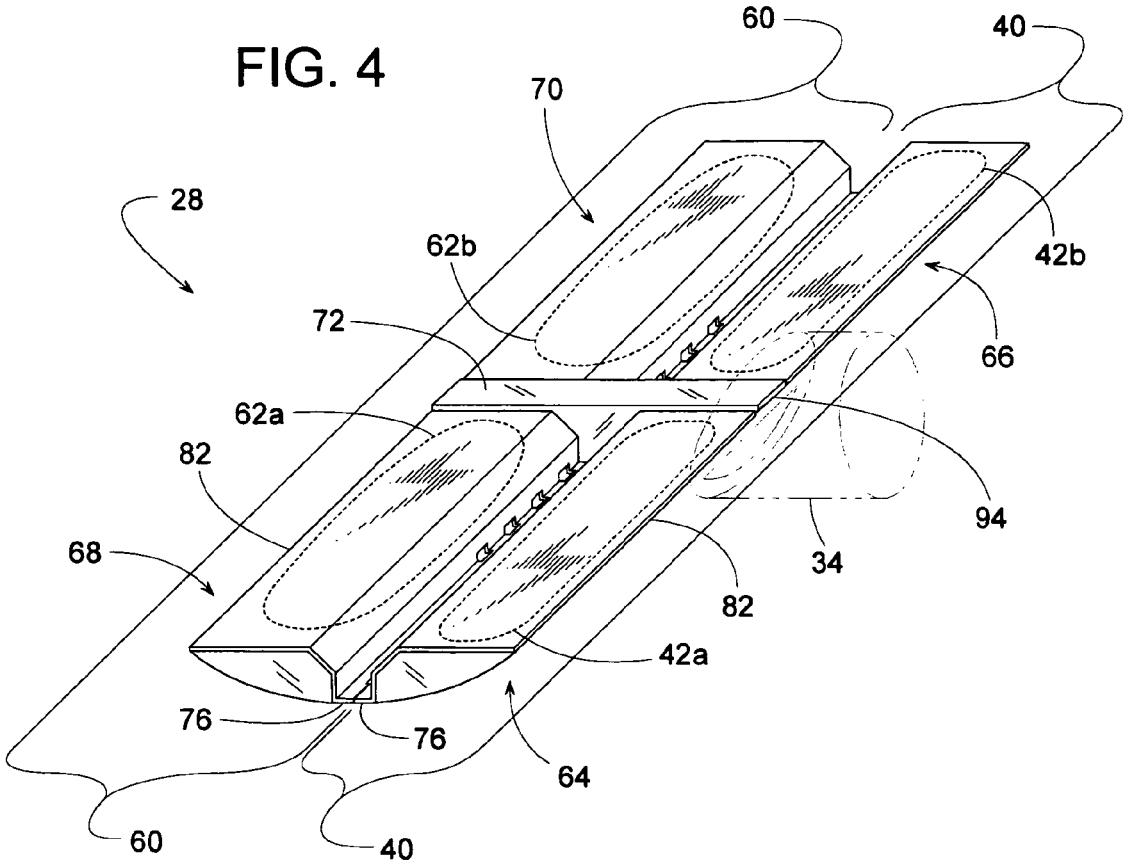
FIG. 4 is a perspective view of the distributor.

To convey liquid and gaseous refrigerant to the various distributor sections, conduit 72 can be formed or fabricated as shown in FIG. 3 and welded in place as shown in FIG. 4. Conduit 72 conveys refrigerant from inlet 26 to distributor 60. Liquid and gaseous refrigerant flows through openings 90 and 92 to feed chambers 62*a* and 62*b*, respectively. Openings 90 and 92 can be sized equally or differently to properly apportion the refrigerant between chambers 62*a* and 62*b*. If section 62*a* were longer than section 62*b*, for instance, it may be beneficial to have opening 90 be larger than opening 92.

Figure 5:
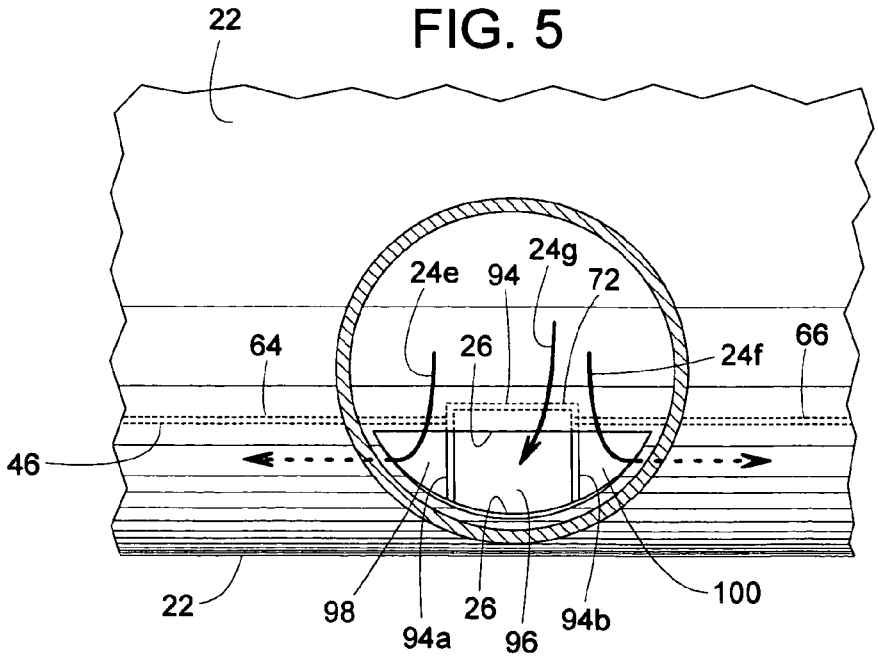
FIG. 5 is a cross-sectional view taken along line 5-5 of FIG. 2.

To apportion the refrigerant flow to chambers 42*a* and 42*b*, an upstream end 94 of conduit 72 lies across inlet 26, as shown in FIG. 5. One side 94*a* of conduit 72 directs refrigerant 24*e* to chamber 42*a* and another side 94*b* of conduit 72 directs refrigerant 24*f* to chamber 42*b*. A central region 96 within conduit 72 feeds distributor 60 with refrigerant 24*g*. Open areas 96, 98 and 100 defined by conduit 94 and the crescent shaped inlet 26 can be sized to properly apportion the refrigerant between chambers 42*a* and 42*b* as well as balance the refrigerant flow between distributors 40 and 60.

Figure 7:
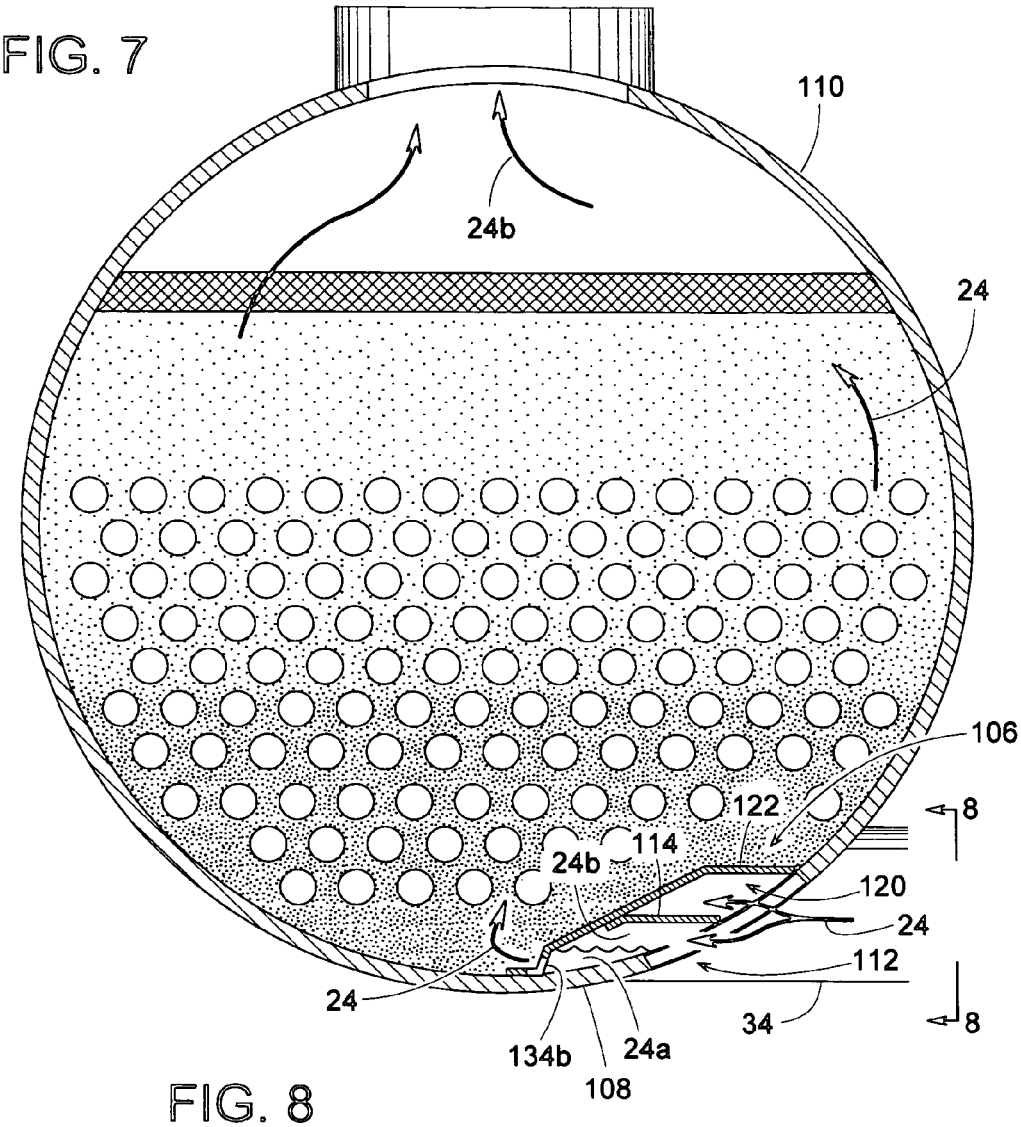
FIG. 7 is a cross-sectional view similar to FIG. 2 but showing an alternate embodiment of the distributor.
Figure 8:
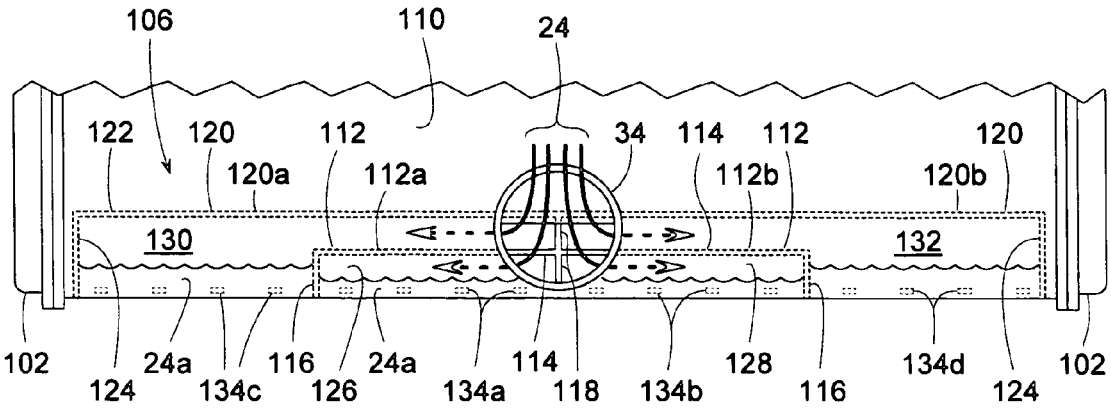
FIG. 8 is a view taken along line 8-8 of FIG. 7.

In an alternate embodiment, shown in FIGS. 7 and 8, a two-tier distributor 106 adjacent a bottom portion 108 of an evaporator shell 110 provides another way of minimizing the amount of liquid refrigerant 24*a* in the shell. A lower tier 112 is defined by a central panel 114, two endplates 116, and the bottom portion 108 of shell 110. A dividing panel 118 can separate lower tier 112 into a first section 112*a* and a second section 112*b*. An upper tier 120 is the space bounded by lower tier 112, the bottom portion 108 of shell 110, an upper plate 122 and two endplates 124. Dividing panel 118 separates upper tier 120 into a third section 120*a* and a fourth section 120*b*, thus distributor 106 comprises four axially offset sections 112*a*, 112*b*, 120*a* and 120*b*.

To displace liquid refrigerant 24*a* with trapped gaseous refrigerant 24*b*, sections 112*a*, 112*b*, 120*a* and 120*b* each include a gas trap chamber 126, 128, 130 and 132, respectively. Beneath the gas trap chambers, liquid refrigerant 24*a* collects immediately upstream of a plurality of outlets 134*a*, 134*b*, 134*c* and 134*d*. Each set of outlets 134*a*, 134*b*, 134*c* and 134*d* delivers the collected refrigerant to different areas of the tube bundle. By apportioning the refrigerant among the four axially displaced sections 112*a*, 112*b*, 120*a* and 120*b*, distributor 106 can interject the refrigerant between tube supports and evenly distribute the refrigerant along the entire length of the evaporator's tube bundle.

Although the invention is described with reference to a preferred embodiment, it should be appreciated by those of ordinary skill in the art that other variations are well within the scope of the invention. Evaporator 18, for instance, is shown as a shell-and-tube heat exchanger with two water-boxes 102; however, other types of heat exchangers with single or multiple passes are certainly possible. The scope of the invention, therefore, is to be determined by reference to the following claims:

The invention claimed is:

1. A system that handles a mixture of liquid refrigerant and gaseous refrigerant, the system comprising:

a compressor, a condenser shell, a flow restriction, and an evaporator shell connected in series flow relationship, wherein the liquid refrigerant and the gaseous refrigerant flow upward through the evaporator shell;

a plurality of heat exchanger tubes disposed inside the evaporator shell; and a first distributor disposed beneath the plurality of heat exchanger tubes, the first distributor and the evaporator shell define a first gas trap chamber therebetween such that a lower liquid/vapor refrigerant level develops within the first gas trap chamber, the liquid refrigerant flows from within the first gas trap chamber and flows generally upward toward the plurality of heat exchanger tubes, the lower liquid/vapor refrigerant level helps momentarily trap at least some of the gaseous refrigerant in the first gas trap chamber, thereby displacing at least some liquid refrigerant therein.

2. The system of claim 1, wherein an upper liquid/vapor refrigerant level develops in the evaporator shell at an elevation that is higher than the lower liquid/vapor level in the first distributor, and the upper liquid/vapor refrigerant level is sufficient to submerge at least one tube of the plurality of heat exchanger tubes.

3. The system of claim 1, wherein both the liquid refrigerant and the gaseous refrigerant flow upward past the plurality of heat exchanger tubes.

4. The system of claim 1, wherein the distributor and the evaporator shell define a leak path therebetween, the leak path allows the gaseous refrigerant to eventually escape the gas trap chamber.

5. The system of claim 1, further comprising:

a second distributor disposed beneath the plurality of heat exchanger tubes, the second distributor defines a second gas trap chamber inside the evaporator shell, the liquid refrigerant flows generally upward from within the second gas trap chamber, the second distributor momentarily traps at least some of the gaseous refrigerant therein; and a conduit that connects the first distributor and the second distributor in fluid communication with each other.

6. The system of claim 5, wherein the first gas trap chamber comprises a first chamber-A and a first chamber-B, and the second gas trap chamber comprises a second chamber-A and a second chamber-B, the liquid refrigerant flows in generally opposite directions through the first chamber-A and the first chamber-B, the liquid refrigerant flows in generally opposite directions through the second chamber-A and the second chamber-B.

7. The system of claim 5, wherein the conduit is disposed within the evaporator shell.

8. The system of claim 1, wherein the first distributor defines a plurality of outlets through which the liquid refrigerant flows from the first gas trap chamber toward the plurality of heat exchanger tubes, the first distributor includes a ceiling that lies above the first gas trap chamber, the ceiling is higher than the plurality of outlets.

9. The system of claim 1, further comprising:

a second distributor disposed beneath the plurality of heat exchanger tubes, the second distributor defines a second gas trap chamber inside the evaporator shell, the liquid refrigerant flows generally upward from within the second gas trap chamber, the second distributor momentarily traps at least some of the gaseous refrigerant therein, the first distributor and the second distributor define a refrigerant passageway therebetween so that liquid refrigerant flowing upward through the refrigerant passageway is more broadly distributed upon reaching the plurality of heat exchanger tubes; and a conduit that connects the first distributor and the second distributor in fluid communication with each other.

10. The system of claim 9, wherein the conduit is disposed within the evaporator shell.

11. The evaporator of claim 2, wherein the gaseous refrigerant in the gas trap chamber is at a higher pressure than the gaseous refrigerant that is above the upper liquid/vapor refrigerant level.

12. The evaporator of claim 1, wherein the mixture of liquid refrigerant when flowing from the flow restriction to the evaporator shell is more than 90% gaseous refrigerant by volume.

13. The evaporator of claim 12, wherein the mixture of liquid refrigerant and gaseous refrigerant in the distributor is about 75% gaseous refrigerant by volume.

14. An evaporator for handling liquid refrigerant and gaseous refrigerant, the evaporator comprising:

a shell that includes a bottom portion and defines an evaporating chamber, the shell also defines an inlet for receiving a mixture of the liquid refrigerant and the gaseous refrigerant;

a plurality of heat exchanger tubes disposed within the evaporating chamber of the shell such that the plurality of heat exchanger tubes are above the bottom portion of the shell; and a distributor disposed inside the shell such that the distributor is above the bottom portion of the shell and below the plurality of heat exchanger tubes, the distributor helps define a gas trap chamber between a ceiling of the distributor and the bottom portion of the shell, the distributor defines an outlet that places the gas trap chamber in fluid communication with the evaporating chamber, the gas trap chamber is in fluid communication with the inlet of the shell such that the liquid refrigerant can flow sequentially through the inlet, through the gas trap chamber, through the outlet and into the evaporating chamber while the gaseous refrigerant flows from the inlet into the gas trap chamber, the outlet of the gas trap chamber is below the ceiling so that the liquid refrigerant in the gas trap chamber tends to flow through the outlet and into the evaporating chamber to create an upper liquid/vapor level of refrigerant within the evaporating chamber, and the gaseous refrigerant in the gas trap chamber tends to rise toward the ceiling to create a lower liquid/vapor level of refrigerant within the gas trap chamber, whereby the upper liquid/vapor level of refrigerant in the evaporating chamber is higher than the lower liquid/vapor level of refrigerant in the gas trap chamber.

15. The evaporator of claim 14, wherein at least one tube of the plurality of heat exchanger tubes is submerged in the liquid refrigerant.

16. The evaporator of claim 14, wherein the gaseous refrigerant in the gas trap chamber is at a higher pressure than the gaseous refrigerant in the evaporating chamber.

17. The system of claim 14, wherein both the liquid refrigerant and the gaseous refrigerant flow upward past the plurality of heat exchanger tubes.

18. The system of claim 14, wherein the upper liquid/vapor refrigerant level traverses the plurality of heat exchanger tubes.

19. The system of claim 14, wherein the distributor and the evaporator shell define a leak path therebetween, the leak path allows the gaseous refrigerant to eventually escape the gas trap chamber.

20. A method of conveying liquid refrigerant and gaseous refrigerant through an evaporator shell that contains a plurality of heat exchanger tubes, the method comprising:

delivering the liquid refrigerant and the gaseous refrigerant into a bottom portion of the evaporator shell;

at least temporarily trapping the gaseous refrigerant within a gas trap chamber that is between the bottom portion of the evaporator shell and the plurality of heat exchanger tubes; and conveying the liquid refrigerant from the gas trap chamber and directing the liquid refrigerant upward to submerge at least one tube of the plurality of heat exchanger tubes.

21. The method of claim 20, further comprising:

releasing the vaporous refrigerant from within the evaporator shell such that the vaporous refrigerant leaves the evaporator shell at a volume flow rate; and allowing at least some of the gaseous refrigerant in the gas trap chamber to leak out of the gas trap chamber at a volume leak rate so that the gaseous refrigerant leaking from the gas trap chamber can subsequently enter into heat exchange relationship with the plurality of heat exchanger tubes, wherein the volume leak rate of the vaporous refrigerant leaving the gas trap chamber is less than the volume flow rate of the gaseous refrigerant leaving the evaporator shell.

22. The method of claim 20, further comprising creating an upper liquid/vapor refrigerant level that traverses the plurality of heat exchanger tubes.

23. The method of claim 22, wherein the gaseous refrigerant in the gas trap chamber is at a higher pressure than the gaseous refrigerant that is above the gas trap chamber.

24. A method of conveying a mixture liquid refrigerant and gaseous refrigerant through an evaporator shell that contains a plurality of heat exchanger tubes, the method comprising:

delivering the mixture of liquid refrigerant and gaseous refrigerant into a bottom portion of the evaporator shell, wherein the mixture upon entering the evaporator shell is at least 90% gaseous refrigerant by volume;

at least temporarily trapping the gaseous refrigerant within a gas trap chamber that is between the bottom portion of the evaporator shell and the plurality of heat exchanger tubes; and conveying the liquid refrigerant from the gas trap chamber and directing the liquid refrigerant upward toward the plurality of heat exchanger tubes.

25. The method of claim 24, further comprising:

releasing the vaporous refrigerant from within the evaporator shell such that the vaporous refrigerant leaves the evaporator shell at a volume flow rate; and allowing at least some of the gaseous refrigerant in the gas trap chamber to leak out of the gas trap chamber at a volume leak rate so that the gaseous refrigerant leaking from the gas trap chamber can subsequently enter into heat exchange relationship with the plurality of heat exchanger tubes, wherein the volume leak rate of the vaporous refrigerant leaving the gas trap chamber is less than the volume flow rate of the gaseous refrigerant leaving the evaporator shell.

26. The method of claim 24, further comprising creating an upper liquid/vapor refrigerant level that traverses the plurality of heat exchanger tubes.

27. The method of claim 24, wherein the gaseous refrigerant in the gas trap chamber is at a higher pressure than the gaseous refrigerant that is above the gas trap chamber.

* * * * *